US005409883A

United States Patent [19]

Larshus et al.

[11] Patent Number: 5,409,883

[45] Date of Patent: Apr. 25, 1995

[54] PROCESS FOR THE MANUFACTURE OF MULTI-COLOR DONOR ELEMENTS FOR THERMAL TRANSFER SYSTEMS

[75] Inventors: David A. Larshus, Maplewood; Richard S. Fisch, St. Paul; Jeffrey C. Chang, North Oaks; Hsin-Hsin Chou, Woodbury, Peter A. Vono, Wyoming, all of Minn.

[73] Assignee: Minnesota Mining and Manufacturing Company, St. Paul, Minn.

[21] Appl. No.: 57,636

[22] Filed: May 7, 1993

[51] Int. Cl.[6] ..... B41M 5/035; B41M 5/38

[52] U.S. Cl. ..... 503/227; 156/235; 400/240; 427/146; 427/152; 428/58; 428/195; 428/484; 428/913; 428/914

[58] Field of Search ..... 8/471; 428/58, 195, 428/913, 914, 484; 400/197, 200, 239, 240, 241; 503/227; 156/235; 427/146, 152

[56] References Cited

U.S. PATENT DOCUMENTS

| | | | |
|---|---|---|---|
| 3,769,124 | 10/1973 | Johnson | 156/159 |
| 4,472,479 | 9/1984 | Hayes et al. | 428/324 |
| 4,923,846 | 5/1990 | Kutsukake et al. | 503/227 |
| 5,064,807 | 11/1991 | Yoshida et al. | 503/227 |

FOREIGN PATENT DOCUMENTS

| | | | |
|---|---|---|---|
| WO91/14581 | 10/1991 | WIPO | 503/227 |

*Primary Examiner*—B. Hamilton Hess

*Attorney, Agent, or Firm*—Gary L. Griswold; Walter N. Kirn; Mark A. Litman

[57] ABSTRACT

A process for the manufacture of a thermal transfer donor element having at least two areas of thermally transferable colorant, at least one of said areas being a thermal dye transfer composition and at least one of said areas being a thermal mass transfer composition, which process comprises coating a first thermal dye or mass transferable layer containing a colorant onto a temporary substrate to form a primary thermal transfer element, said layer having a measurable surface area, and either 1) thermally transferring less than all of said layer onto a second temporary substrate having a non-imagewise distributed area of a second thermally respectively mass or dye transferable colorant thereon to form a thermal transfer donor element with at least two areas of different thermally transferable materials, or 2) splicing a portion of only one primary thermal dye or mass transfer element onto another thermal transfer element having at least a non-imagewise distributed second thermal mass or dye, transferable, respectively, colorant thereon to form a multi-color thermal transfer donor element having at least one area of thermal dye transfer donor material and at least one area of thermal mass transfer donor material on said element.

23 Claims, No Drawings

PROCESS FOR THE MANUFACTURE OF MULTI-COLOR DONOR ELEMENTS FOR THERMAL TRANSFER SYSTEMS

BACKGROUND OF THE INVENTION

1. Field of the Invention

The present invention relates to the production of thermal transfer sheets or ribbons, particularly donor transfer sheets of multiple, different colors laid down on a carrier layer by different processes, with different optical properties amongst the colors, or with combinations of normal and exotic colors. The process is particularly applicable for use in proofing, graphic arts (for the images themselves, for local area images (e.g., spot images) on top of other images), or animated film production, where large numbers of colors may be needed in a wide variety of volumes.

2. Background of the Art

The visual quality of a graphic arts spot color opaque image or an animated film is readily observable as a function of the quality and detail of the individual picture frames. The individual frames in the film of an animated production are photographic images taken of individual pictures of each individual frame. In the art of motion picture animation these individual pictures are called "cels". A "cel" may consist of several sub-cels, each of separate image areas. In the highest quality cels, the background area (sub cel) is drawn, usually by hand, and hand painted overlays of the active characters are placed over the background areas in overlaid sub-cels and the composite scene photographed. The active character Figures are progressively different (and individually painted that way) for each cel. This is an exceedingly expensive procedure when the highest quality images are desired.

In lower quality animated films, such as those often produced expressly for low budget television, expenses are reduced by reducing the degree of activity of the characters. With lower levels of activity, the background area can encompass greater proportions of the active character, with less of the character having to be drawn to show its movement. For example, the background could include the normal scenic background and all of the character except for its mouth. The only overlay for the cel would have to be the moving lower jaw of the character to show that it was speaking.

Modern animated films can now use computer driven imaging systems to create the cels. The cells may be hand drawn and scanned, drawn on a digital screen and converted to digital data for the computer, and the data may be enhanced by computer programs. Various programs are available where the computer can create the data of intermediate images between two scenes by a process called 'morphization,' where given a beginning position and an end position for a Figure, the computer will generate the intermediate frames without the need for hand drawing. Any system which is capable of being data driven by a computer may be used as the image output system to produce the actual cels, but color negative photographic imaging provides the highest quality images for the motion picture industry. This is still an expensive procedure and does not provide a wide range of flexibility in the production of the cel.

There are also specific properties in the image of the cel which limit the types of imaging systems which could be useful in the manufacture of cels. For example, specific image areas in the overlays must be opaque so that the background does not show through the overlay. The traditional process for making animation cells is shown in U.S. Pat. No. 2,351,634 (W. Disney) and British Patents 595,255 (W. Disney) and 531,094 (R. Place). Opaque, hand-applied paints are used for each feature in the overlay of the cels.

Once the image and background cels are overlaid, they are photographed onto color negative photographic film. One frame of photographic film is exposed for each final frame image needed in the final film, which may be as many as hundreds of thousands of frames for a full length animated movie.

One other method which has been used to reduce the labor intensive steps in the animated film making process includes electronic printing. In that manner image assembly is combined with integral opaquing (that is opaquing steps that are an integral part of electronic imaging).

Each color which is used in the formation of the cels adds additional expense. The number of colors used in the animation is such a large factor in the cost of a production, that it is a part of the animated film making process to assign one individual, the Color Model Advisor, to analyze the animators' drawings for excessive detail, particularly with respect to excessive numbers of colors. As an example of this process, it is said that Jiminy Cricket had as many as twenty-seven colors in the Walt Disney animated film version of Pinocchio. When that same character was used on the Walt Disney Mickey Mouse Club films, the number of colors used was only nine. This was a very significant cost savings. Even the simplest characters will have at least about nine colors, so the cost of the production is greater with significant artistic enhancement of the character image, which would require many more colors.

Additional expenses are incurred in putting any color background or character on the screen. To begin with, each color utilized in an image represents an expense in itself. Each artist must have access to custom made bottles of ink with at least twice that quantity of colors estimated to be necessary for the full production requirements to insure production color quality control. The actual steps involved in cel production include paint mixing (and color control of the mixed paint), packaging and dispensing (to the various individual painters), precision "cel" area painting and drying times. All these times are additive for each color. Bottled color ink inventory control and remixture, when use exceeds inventory, causes color changes that waste time. Time can be reduced somewhat by means of computer directed dry color imaging and opaquing.

Eventually, the individual color or composite "cels" have to be photographed onto a color photographic media which has the capability of producing over 1.6 billion colors. The limited color gamut imposed by hand color ink mixing and "cel" inking restrict the final quality of the production. The special effects art and design techniques are even more labor intensive. The advent of the computer tended to eliminate some of the mechanical drudgery, but cel production still used labor intensive means.

Yet another labor intensive, but traditional animation operation, is "a self ink line". To keep the color within the image outline, each separate color must have an outline around it defining its border to the area next to it. In a particular Figure, the hat is one color, the hair another, etc. When these outlines are done using black ink, there is a heavy, crude look that is fine for some characters, but unacceptable for more delicate ones. Colored inks were tried and were an improvement, but when a look of quality and careful shading was needed, they were still too strong. Presently, lines may be inked on the back of the cel. The paint used is diluted to soften it. The combination of the diffusion effect and the diluted ink allows better colored image outline scarcely noticed on the screen. This technique provides soft color changes, delicate shades, and subdued values.

Additionally, the fully painted "cel" itself can represent a problem, the solution of which complicates production time and expense. Looking at a composite "cel" of Snow White, Disney's artists felt that the black hair looked unnatural and harsh, They added a wisp of dry-brush in a lighter grey to soften the edge of her hair. It helped immensely, so they proceeded to add it to every cel all through the picture. This had to be done on top of the cels, and the only way to be sure the effect was working from one to the next was by flipping the whole sheet of celluloid, heavy with paint. The task was effective but it was tiring and risked cracking the paint. This risk is still taken on important productions.

The means of production and subsequent reproduction of each cel in a single frame of, and in a complete motion picture has been detailed in U.S. Pat. No. 2,281,033 by Garity assigned to W. Disney as well as *Disney Animation, the Illusion Of Life* by F. Thomas and O. Johnston, Abbeville Press, N.Y. 1981 pages 47–71, "The Principles of Animation"; and "How to Get it on Screen" pages 243–285. Such techniques are as efficient with respect to today's technologies as is the use of room filled mainframe computers is to desk top imaging systems.

The use of thermal transfer systems would significantly help in the reduction of costs, but the need for a large number of different and unusual colors from those ordinarily in production would tend to maintain a higher level of cost than is desired. It is therefore important to provide a process for readily manufacturing thermal transfer donor materials of a variety of tailored colors at a lower cost than can be done by present manufacturing techniques for thermal transfer donor materials.

Donor sheets, film or ribbon elements which may be heated on one surface to transfer colorant (dye, pigment, pigment in a binder) to a receptor surface are used in thermal imaging processes. Donor sheets are typically made by a single type of process for applying each and every colorant to the donor sheet substrate.

BRIEF DESCRIPTION OF THE INVENTION

It has been found in the practice of the present invention that thermal transfer imaging donor sheets can be manufactured by processes which readily reduce costs, improve the consistency of the color, reduce waste of the materials used in production, and provide a simplified means for inspecting the quality of the donor sheets.

The processes of the present invention comprise coating large primary sheets (large relative to the dimensions of thermal transfer donor sheets and especially donor ribbons) with the thermal transfer composition, then transferring this composition to the final donor sheet backing material. The transfer step may be done, i.e., by thermally transferring composition from the primary sheet to the final donor element, or by splicing segments of the primary sheet to a final donor element. By first coating the composition onto a large sheet, coating flaws can be readily detected by visual means and eliminated by cutting out those areas or not using those areas to transfer thermal transfer material to the donor sheet backing layer. Because the composition can be made in a large batch, the consistency of the color is much higher throughout the entire lot. The thermal transfer composition can be applied to the large area primary sheets by any conventional coating method such as slot coating, knife edge coating, curtain coating, spin coating, gravure printing, silk screen printing, vapor deposition, sputtering, ink jet coating, extrusion coating and the like. Any known thermal transfer composition which can provide the colors in the desired optical densities can be used in the practice of the present invention. In addition, donor sheets can be constructed with patches or areas of thermal donor materials which are made by different processes and can be transferred by the same equipment, but by different processes. For example, thermal dye transfer segments may be combined with thermal mass transfer segments and imaged in the same equipment, in succession, to form a single image with composite dye and mass transfer portions in the image. Only modest external or computer driven control of the thermal printing apparatus should be exercised to control the burn profile or burn intensity to use the different processes in a single image.

The thermal transfer donor systems of the present invention can be used to provide individual cels for use in the production of animation films. The donor systems of this invention may also be used for reflective viewing graphic images where color reproduction requirements are for local area opacity rather than for transparency. The thermal transfer process can provide both backgrounds and overlays which are selectively opaque. The process can provide a variety of colors as the thermal transfer donors can be provided in large quantities with a large variety of colors available.

Because the colors in the cels are not made using Colorants containing opaque agents but are provided by saturated over reflecting opaque colors, greater saturation (or color fullness) is achieved by the use of this technique.

DETAILED DESCRIPTION OF THE INVENTION

The processes of the present invention comprise a procedure for the manufacture of thermal transfer and thermal mass transfer donor sheets and ribbons by providing a thermal transfer coating composition, applying that coating composition to a temporary support substrate having a first surface area, (preferably at least partially drying the coating composition on said temporary substrate) and then thermally transferring the dried coating composition or a segment of the dried coating on the temporary substrate to a final donor backing sheet having a second surface area less than one-half that of the first surface area. The transfer to the donor backing sheet is not done in what would conventionally be considered to be an imagewise manner. The transfer is done so that a continuous patch or complete panel area of the final sheet or ribbon is covered by the composition or completed by a segment of the coated temporary substrate. Although the entire first surface area is not heated during the thermal transfer step alternative of the final sheet manufacturing transfer process to the donor backing sheet, and the temporary support is heated in the 'image' of the patch or area to which such thermal transfer is desired, this step is not an imagewise transfer which denotes greater detail than a surface-to-surface uniform coating of thermal transfer composition on the donor sheet.

The physical addition of a color panel to the final donor sheet or ribbon may be done in any of a number of physical joining processes. For example, segments of a number of different primary sheets may be taped together, with the tape on the side of the sheet away from the transfer material (i.e., the side of the sheet which is heated has the tape thereon). The segments of the primary sheets may be welded together, as by dielectric welding which is conventionally been used to splice magnetic tape and motion picture film. Coated or uncoated leader lengths of the primary sheet may be adhesively secured together to form the final sheet or ribbon. The use of a rapidly curing (e.g., ultraviolet radiation curable adhesive) would be particularly desirable in this type of process. Any of the well known acryloyl or methacryloyl, photosensitized curable adhesives would be particularly useful for this type of process. Photosensitizers such as s-triazines, diaryliodonium initiators, triarylsulfonium initiators, biimidazoles, and the like are particularly suitable.

Typical thermal transfer compositions which may be used as coating compositions (in solvent, pure and binderless, or liquid dispersion states) in the practice of the present invention include all those described in the art and literature of thermal transfer imaging. As the segments may be transferred by thermal transfer, the availability of these varied materials can be readily understood. As the coatings can be applied to distinctly different substrates, the availability of final sheets and ribbons with highly diverse coloring segments can be readily attained.

For example, one final thermal donor sheet can contain patches of vapor deposited metal pigments, fluorescent pigment, opaque thermal mass transfer colorant, and translucent thermal dye transfer materials. By cutting and splicing these materials together from primary thermal transfer sources, an infinite variety of multicolor donor sheets can be provided, each sheet being tailored by the selection of individual colors for the production of a particular image or series of images. Both traditional (e.g., red, yellow, blue, green, cyan, magenta, and black) colors may be used or non-traditional colors (fluorescent colors, white, gray, brown, metallics, shiny metallics, opaque white, opaque colors, and the like) may be used. Of particular benefit is an opaque, particularly opaque white thermal mass transferable composition. This can help form opaque color images with non-opaque overcoatings of other colors, both with mass transfer and surprisingly with dye transfer on top of the opaque (particularly opaque white) transferred image. By opaque it is meant that the deposited image has an optical density of at least 1.0 or at least 2.0 (to reflected light) and more preferably at least 2.5, and most preferably at least 3.0.

It was surprising in the practice of the invention that there was almost no criticality in the thickness of the splice between the segments. Commercially available office adhesive tape, such as Scotch Brand Magic Transparent tape works well in the practice of the present invention. The substrates for each of the different color panels or segments may also vary widely. The only caution that must be exercised is that the imaging device (the thermal printer) be aware (as by computer control and programs) of the varying thickness so that the burn profile for the thermal heads or lasers may be varied as needed.

The process of this invention may also include the thermal transfer of the composition from the donor backing sheet to a permanent receptor in an imagewise manner by thermal transfer, or even transfer to an intermediate receptor in an imagewise manner.

The office size provers or proofers assisted by table top computers of the design detailed in U.S. patent application Ser. No. 07/752770 when applied to animation help insure a reduction in the time and manpower needed for the production of animated motion pictures. The use of such means provides the elimination of the separate ink bottles and the necessary constraints on the colors employed. In the case of the initial areas of subject or story concept, art and design, a proofer based using a dry imaging material such as dye sublimation imaging or a toner ribbon consisting of panels, each using intermixed thermal transfer technologies, allows a full or partial preview hard copy image of an existing electronic file instead of black and white copy. Such hard copy color proofs made separately (each with its own small image progressive change) can be assembled in order, grasped by the user, and flipped to give the impression of movement much like that provided by the original hand kinescope and described in the aforementioned book, *Disney Animation, The Illusion of Life,* on pages 31–32.

Although such devices can output highly saturated color images which can be made to sublimate a set of industry standard colors by the techniques disclosed, the conventional, transparent colors offered by such thermal systems do not meet all the needs of the creative capabilities of the artist, art director or client since they are not opaque enough to allow differentiation between the animated subject and the background, nor provide means to selectively opaque a portion of an image area and allow another portion to remain clear.

For example, in the case of an animated character on a background, it is imperative that much of the character's form be visible against a background that might move (to give the illusion of the character itself moving). In such a case, a character or portion of a character may be produced using the dye sublimation process and the thermal mass transfer materials described in U.S. patent application Ser. No. 07/946871 or by using the techniques disclosed in U.S. patent application Ser. No. 07/932087 and U.S. Ser. No. 07/862346. When only portions of the animated character are opaque and the background fully opaque, the materials and processes of U.S. Ser. No. 07/946871 allow that technique to be inexpensively achieved by means of special receptor sheets. Dye sublimation ribbons that contain 3 or 4 transparent color dye panels, with additional panels of a heat transferable white reflecting layer and means for the assembly into ribbons has been disclosed by the authors in that Application. That Application is incorporated by reference for its teaching of the means for manufacturing thermal transfer ribbons and sheets.

Such opaque images serve as a portion of an overlay image assembly useful for animation "cels" and graphic arts design applications requiring overlays of single or multiple color images on top of a background images. At least one such image overlay portion is distinguished by its need to hide the image or color below it.

Additionally, such animation "cels" can be made using a single sheet composite "cel" wherein a transparent support is first imaged using a background image and then overprinted with an opaque layer corresponding to the outline of a second image to be overlayed on a portion of the first image. Over this composite a transparent color image corresponding in size and in register with the opaque image is applied. Third or additional images can be overlayed by first allowing an opaque image to be produced in a desired position and then dictating the in-register additional transparent color image over this last opaque image. In such a manner, several images can be superimposed on each other, allowing a single sheet composite equal to several separate overlay "cels". The advantages in this technique over multiple layer "cels" include reduction in light scattering between each of the different "cel" surfaces during exposure onto motion picture intermediate or release stock, reduction in the handling of the fragile overlay image areas, and the ability to incorporate more character-independent images without adding "cels" to an already thick package of individual "cel" sheets.

The proofer or printer of this invention shall be capable of producing from 1 to over 5 different overlay images. At least one of these overlay images requiring visible separation from the other images. The proofer described in U.S. patent application Ser. No. 07/752770 authored by Fisch, Larshus and Jongewaard is preferred in the practice of the present invention, although an alternate thermal printer may be employed.

The imaging materials (now called donor sheets or materials) should be available in sheet or roll form, preferably in roll stock. Additionally, when in roll stock as panels of color, each of said panels shall consist of at least 3 colors, usually 4 or five colors, and as many as 10 colors. Each panel shall consist of a sequence of colors as needed arranged in any order useful in the animation system. Each panel shall contain at least one opaque segment (which preferably may be a white segment, but may also be any other opaque color or tone such as black, blue, red, metallic or the like) in addition to traditionally transparent color segments, including black. An optional black opaque color is also desirable. (For a review of prior art on opaque colors see U.S. Ser. No. 07/946871 and the above-identified U.S. patent application filed concurrently with this application, concerning the thermal proofing of graphic arts opaque images.) When an opaque black or two black panels are provided in a donor roll an optional sequence for the panel, colors may be at least black (preferably opaque), yellow, magenta, and cyan in any order, followed by a transparent black, then an opaque white layer.

The sequential color panels may be coated by various means, including gravure, to enable each panel to have a diverse color. The color sequence for such stock may be coated in order or assembled by any of various techniques. The matching of "cel" thermal image colors to the spectral sensitivity of the intermediate motion picture stock used in the motion pictures or to the colors formed by exposure and chromogenic development of the final printing stock is accomplished through the use of techniques disclosed in U.S. patent application Ser. Nos. 07/784469, 07/932087 and 07/862346. Minimization of the inter layer reflections due to the illumination process for "cel" and background simultaneous imaging is reduced by the use of antireflective coatings such as sol gel coatings, which form continuous gelled networks of inorganic oxide (and metal oxide) colloidal particles.

EXAMPLE 1

Opaque panels of white heat transferable material were inserted into a roll of four color dye sublimation donor ribbon in position after the black panels of a commercially available YMCK sequence by physically splicing a white opaque thermal mass transfer segment to the ribbon by dielectrically welding that white segment to the ribbon. The commercial color ribbon roll is available commercially as 3M Rainbow Proofing Ribbon #PE-433.

Construction of the white opaque panel.

The panel consists of a single coating of white opaque material of 2–3 micron thickness on a polyethylenetere.

The coating mixture consists of:

5 parts Titanium Dioxide Dupont R902 (average particle size 100 nm)

3 parts of $Al(OH)_3$ Alcoa Space Rite S-11 Aluminia Alcoa Bauxite AR 2 parts of XG-11 Carboset Polymer (a styrene-acrylonitrile resin by Goodrich, Cleveland, Ohio) dispersed in Isopropanol.

Transmission Optical density of said panel is about 3.0 using the visual response of a Macbeth TR527 densitometer. Since the TR527 measures both transmitted and scattered light it is not a good indicator of the covering power. An optical density of about 3.0 can cover background images adequately.

Using an Apple Macintosh TM Quadra Model 950 computer and a computer drawing program an image of a face was constructed. Using Aldus "Freehand TM" portions of that image were colored so that the eyes were blue, the nose red, and the full face opaque white.

EPS Separation files were constructed from this image and the digital information describing the face communicated to the print head to enable construction of a 4 color plus opaque white hard copy image of said head by means of printing using the 3M Brand Rainbow TM Dye Sublimation proofer onto a transparent film supply available as 3M Rainbow Transparency Receptor. After printing this image on its transparent base was caused to overlay a reflective 4 color image on a substrate. The face image was seemed to be on top of the background image with no detail of said background showing in the face.

The same image without the white opaque image was again printed on said printer onto a transparent support. When this fully transparent image and substrate was overlaid onto the same a reflective 4 color image on a substrate. The face image was seen top be a part of the background image with details of said background showing in the face.

EXAMPLE 2

A black and white outline image of the face of Donald Duck (a registered Trademark of Walt Disney Studios) was scanned, using a desk top reflection scanner and a data file representing it was sent to an Apple Quadra Model 950 Computer. A computer application program Freehand available from Aldus TM resident in the Apple was used to produce and outline image of said face. That outline image was saved as overlay 1, black opaque. The same image file was used to provide an on screen representation that was area colored (face, bill, eye socket, eyes, etc.) with each area colored and saved as an individual file. The files were saved as overlay 2, yellow, overlay 3, magenta, overlay 4, cyan, overlay 5, black. The same file image was used to provide an on screen representation of the image and areas requiring a color opaque effect designated and saved as overlay 7, w.opaque. Using the printer described in FN 46799USA9A U.S. Ser. No. 07/752770 and containing a dye sublimation donor ribbon consisting of color panels assembled in the following order opaque black, yellow, magenta, cyan, black, white opaque each of the overlay images files were sent to the printer and a thermal color image of each was produced onto individual sheets of 3M Transparency Rainbow Receptor material. Using said printer a solid color red was made to transfer to a reflective 3M Reflection Rainbow Receptor. The respective now printed overlay images were then assembled in register over each other and placed on the red receptor. A full color image of Donald Duck (a registered Trademark of Walt Disney Studios) outlined in black was seen on a red color background. No color effect from the background image was seen through the colored portions of the duck.

EXAMPLE 3

The color overlays were of Donald Duck(TM) in register over a back lighted viewing box and photographed onto slide film. When developed a full color image was seen in said slide film.

EXAMPLE 4

A unused transfer layer as described in FN 47792USA2A, U.S. Ser. No. 07/946871 was applied to the back surface of 3M Transparency Rainbow Receptor material and placed into the printer described in examples 1 and 3. Besides offering a dye receptor layer the transfer layer provided an anti curl layer. The same donor sheets used in examples 1 and 2 were also employed. The data files of example 2 were used in this example.

Overlay file 1 was sent to the printer after directing the printer to make a mirror image of the file and printing this image a black opaque outline image of the duck was seen on the backside of the 3M Transparency Rainbow Receptor.

This now imaged receptor was placed into the printer with the non imaged side of the 3M Transparency Rainbow Receptor facing the thermal print head of same printer and the printer directed to produce a full 4 color plus opaque image output onto the 3M Transparency Rainbow Receptor. After imaging, a full four color plus opaque image is seen on one side and a black outline of the images is apparent on the other side. When rephotographed onto slide film a full color representation is seen with a soft black outline image.

EXAMPLE 5

To 400 gm of Nalco 2326 silica dispersion was added 2600 gm of distilled water and 180 ml of a 4 percent solution by weight of surfactant sodium salt of alkylaryl polyether sulfonate (Rohm and Haas Co. Triton X-200). This dispersion was coated onto the backside of sheets of 3M Transparency Rainbow Receptor material and placed dye receptor side up into the printer described in examples 1 and 3. The same donor sheets used in examples 1 and 2 were also employed. The data files of example 2 were used in this example. As in example 2 images were recorded onto individual sheets of 3M Transparency Rainbow Receptor material. Using said printer, a solid color red was made to transfer to a reflective 3M Reflection Rainbow Receptor. The respective now printed overlay images were then assembled in register over each other and placed on the red receptor. A full color image of Donald Duck(TM) outlined in black was seen on a red color background. No color effect from the background image was seen through the colored portions of the duck.

When the samples of example 2 and this example were compared it was seen that the inter reflections of light off the various film layers of example 2 were apparent and that the image was not easily seen or recorded without objection as compared to the objects of this example.

EXAMPLE 6

Digital image files containing representations of the Disney character "The Little Mermaid" (a registered Trademark of Walt Disney Studios) used in the motion picture of that name consisting of a background, the mermaid body, the mermaid face and the mermaid eyes are used in this example.

Using the 3M Printer previously described, a series of color donor panels of the type described herein consisting of a yellow, magenta, cyan, black layer and opaque white are used to produce a background dye sublimation image using the image file designated as background on a 3M Brand Rainbow Transparent Receptor, over this file an opaque white image corresponding to the file called mermaid is transferred onto the above mentioned 4 color image. Over this opaque image the 4 color file called mermaid body is thermally dye sublimated in register with the existing opaque layer. A file called mermaid body is then called up and an second opaque outline corresponding to the mermaid head is applied over the existing background and mermaid body composites image in correct position to the full image of the background and body. A full color image of the Mermaid head is applied to the third opaque image by thermal means. A fourth opaque image is applied to the aforementioned single sheet composite in the mermaid head corresponding to the position of eyes within the head. A four color image from the file corresponding to the mermaid eyes is then dye sublimated on top of said fourth opaque image thus producing a composite color image of a mermaid with eyes onto a background. When viewed by transmission this composite single sheet "cel" shows no evidence of the images that appear beneath each of the portions of the image.

EXAMPLE 7

A digital file is made of the Disney character "The Little Mermaid"(TM) used in the motion picture of that name consisting of a background, the mermaid body, the mermaid face and the mermaid eyes as used in Example 6.

Using the program "Freehand TM" by Aldus TM, the Background file was previewed on a monitor and the Mermaid file positioned over it in a overlay file mode. A cut out action was performed on the background image corresponding to the position desired for the mermaid body and that modified background file saved. Additionally overlay files were made of the mermaid head and mermaid eyes with the same cut out background action performed and these files saved.

Using the 3M Printer previously described, and a series of color donor panels of the type described herein consisting of a yellow, magenta, cyan, and black and an opaque white panel are used to produce a four color background dye sublimation image containing cutouts corresponding to other image areas to be applied into said background using the image file designated as background minus cut out on a 3M Brand Rainbow Transparent Receptor.

Over this image exactly over the image cut out area a opaque white image corresponding to the file called mermaid plus new cut out is transferred. Onto the cut out area on the image of the background plus the mermaid body mentioned 4 color image. Over this opaque image the 4 color file called mermaid body plus new cut out area is thermally dye sublimated in register with the existing opaque layer. A file called mermaid eyes is then called up and an second opaque outline corresponding to the mermaid head is applied over the existing cut out portion of the background. Mermaid body composites image in correct position to the full image of the background and body and corresponding to the opaque area of that image. A opaque image corresponding to the cut out is applied to that area and then a full color image of the mermaid head is applied to this third opaque image. By thermal means a fourth opaque image is applied to the aforementioned single sheet composite in the mermaid head corresponding to the cut out position of eyes within the head. A four color image from the file corresponding to the mermaid eyes is then dye sublimated on top of said fourth opaque image thus producing a composite color image of a mermaid with eyes onto a background. When viewed by transmission this composite single sheet "cel" shows no evidence of the images that appear beneath each of the portions of the image.

EXAMPLE 8

A black and white outline image of the face of Donald Duck (W. Disney) was scanned, using a desk top reflection scanner. Data file representing the duck image was sent to an Apple Quadra TM Computer. A computer application program Freehand TM available from Aldus TM resident in the Apple was used to produce and outline image of each face areas. The face area was then saved and an outline of that face area saved to be used to provide an opaque representation corresponding to that area. For example, the overall duck bill image was saved as "bill image" and its opaque outline save as "bill opq".

Using the printer described in FN 46799USA9A, U.S. Ser. No. 07/752770 which contained a dye sublimation donor ribbon consisting of color panels assembled as per U.S. patent application Ser. No. 08/000,000 filed the same day as this Application and bearing Attorney's Docket No. 4932_USA9A with color panels arranged in the order of black, opaque, yellow, white opaque, magenta, white opaque, cyan, white opaque and black, white opaque. The hard copy receptor material used in this example was 3M Brand Rainbow TM receptor. Also utilized were the method and process for adjusting colorants in a reproduction FN (Rylander and Ver Merlen and Fisch and Larshus). Such means were employed to provide color matching of the donor colors to that of the final color used in the photographic process for producing animation images.

The image files were sent to the printer in the following order. the first image printed on the receptor was that of the opaque area corresponding to the face itself. Without removing the receptor in register with the previous image, that of the color of the face was thermally imaged onto the receptor. Without removal of the receptor from the proofer in register with the previous image removing the receptor from the printer. The opaque area corresponding to the duck bill was printed over the already existing image of face plus opaque image of the face image using the opaque panel of the donor ribbon. Without removing the receptor from the printer the next image transferred from the file, that of the color of the bill was thermally imaged onto the receptor without removal of the receptor from the proofer in register with the previous image. the same actions were repeated until opaque areas and color images were sequentially produced onto the reflection stock to enable a full reproduction of the duck. When imaging was complete a full color hard copy reproduction of the duck was apparent. At not point where an opaque area was used in conjunction with an image area of the same shape and size was the background color of the image area observed.

The reflective image thus produced did not match that of the same image on the Apple color monitor. this is to be expected since the monitor and reflective copy to don't use the same color mixing technique, e.g, the monitor uses additive printing, the hard copy subtractive printing. The monitor provides no useful prediction of the image when subsequently printed for production measuring using subtractive techniques. This phenomenon is recognized and has been repeatedly reported. Such recent reports include, Color Gamut Mapping and the Printing Process by Stone, Cowwan and Beatty in ACM (Association for Computing Machinery) "transactions on graphics" 10/88 Vol. 7, No. 3, pages 249 to 293 and TAGA (Technical Association of the Graphic Arts) 1992 Proceedings Vol. 2, "Comparisons of Color Images Presented in Different Media, That are Intended to Simulate Each Other or Another Image, especially "Techniques for Reproducing Images in Different Media: Advantages and Disadvantages of Current Methods by T. Johnson TAGA Proceedings 1992 Vol. 2 pages 739 to 755.

Using the computer stored image and opaque form files of this same image and the identical printer and donor ribbon this time however transparent receptors were employed instead of reflective receptor. The transparent receptor used was 3M Brand Rainbow Transparency Receptor.

The computer stored files of each of the images and their corresponding opaque areas were sent to the printer however instead of all of the file images being reproduced over one another to provide a single sheet final image each image set was produced on to a separate transparent receptor, e.g., the opaque portion of the duck face and its corresponding in register full color image was reproduced on a different transparent support until a series of separate transparency images corresponding to the final image (a animation "cel") was produced.

Using a lighted viewing box color corrected for the intermediate color negative photographic color negative imaging film imaging film used in animation production the overlay material were imaged onto Eastman Kodak (EKC) Kodak Color Negative Film a product of Eastman Kodak, Rochester NY USA as described in their information booklet H-1-5245 which in turn was contact imaged onto (EKC) Kodak Color Positive Release Film a product of Eastman Kodak, Rochester NY USA.

The final color reproduction on EKC Color Positive Release Stock is a function of the colors in the "cel" the color spectral sensitivity of the EKC Color Negative Film, the masked color images produced the Color Negative stock the spectral sensitivities of the EKC Color Positive Release film and the color of the images of the Positive release film. The sum of these interactions a produce color reproduction changes even greater than those reported in the preceding references, thus minimizing the prediction of the animation color on the motion picture screen by viewing the same images on a color monitor or by the "cels" themselves.

The color hard copy provided a close match in color to that of the final image on color positive release film than that of the monitor. Thus providing a proof which predicts the color of the final image.

What we claim is:

1. A process for the manufacture of a thermal transfer donor element having at least two areas of thermally transferable colorant, at least one of said areas being a thermal dye transfer composition and at least one of said areas being a thermal mass transfer composition, which process comprises coating a first thermal dye or mass transferable layer containing a colorant onto a temporary substrate to form a primary thermal transfer element, said layer having a measurable surface area, and either 1) thermally transferring less than all of said layer onto a second temporary substrate having a non-imagewise distributed area of a second thermally respectively mass or dye transferable colorant thereon to form a thermal transfer donor element with at least two areas of different thermally transferable materials, or 2) splicing a portion of only one primary thermal dye or mass transfer element onto another thermal transfer element having at least a non-imagewise distributed second thermal mass or dye, transferable, respectively, colorant thereon to form a multi-color thermal transfer donor element having at least one area of thermal dye transfer donor material and at least one area of thermal mass transfer donor material on said element.

2. The process of claim 1 where said colorant on said primary element is transferred to a second temporary donor substrate by thermal transfer means.

3. The process of claim 2 wherein said process of transferring by thermal transfer means to said second temporary donor substrate is repeated on different areas of said second temporary substrate with different colorants to form a donor element which can provide more than one color during a thermal transfer process.

4. The process of claim 3 where at least four separate areas of at least four different colors are deposited onto said second temporary substrate.

5. The process of claim 4 wherein said donor element is a donor ribbon.

6. The process of claim 4 wherein one area and only one area of said at least two areas of different thermally transferable materials consists essentially of a thermal dye transfer colorant.

7. The process of claim 4 wherein a different burn profile is used for at least two of said at least two areas of thermally transferable material.

8. The process of claim 7 wherein a different burn profile is used for at least two of said at least two areas of thermally transferable material.

9. The process of claim 2 wherein there is a binder containing a colorant which is deposited onto said first temporary receptor as said first thermally transferable layer.

10. The process of claim 2 wherein during the transfer of said colorant to the second temporary receptor less than twenty-five percent by weight of the total colorant on said first temporary receptor is transferred to said second temporary receptor.

11. The process of claim 10 wherein said transfer to said second temporary receptor is done in a non-imagewise fashion.

12. The process of claim 1 wherein at least one color segment on said final thermal transfer donor element is spliced onto said final thermal transfer element.

13. The process of claim 12 wherein at least one splice is accomplished by adhesive tape between segments.

14. The process of claim 12 wherein at least one splice is accomplished by welding.

15. The process of claim 14 wherein one area and only one area of said at least two areas of different thermally transferable materials consists essentially of a thermal dye transfer colorant.

16. The process of claim 12 wherein at least one splice is accomplished by adhesive attachment of two segments.

17. The process of claim 12 wherein at least two different color segments are present on the final thermal transfer sheets and said two different color segments are formed by different coating processes selected from the group consisting of gravure printing, extrusion coating, slot coating, vapor deposition, sputtering, screen printing, spin coating, ink jet coating, and knife edge coating.

18. The process of claim 1 wherein said colorant on said primary surface comprises a thermal mass transfer composition.

19. The process of claim 1 wherein one area and only one area of said at least two areas of different thermally transferable materials consists essentially of a thermal dye transfer colorant and at least one of said at least two areas consists of a thermal mass transfer colorant.

20. A process for thermal transfer imaging comprising the steps of contacting a surface of the multicolor thermal transfer donor element formed by the process of claim 1 with a receptor sheet so that at least one colorant is in contract with a surface of said receptor sheet, sequentially imagewise heating said at least two areas of different thermally transferable materials with a heating element having a burn profile to transfer those materials in imagewise fashion to said receptor.

21. The process of claim 20 wherein a different burn profile is used for at least two of said at least two areas of thermally transferable material.

22. A process for the manufacture of a thermal transfer donor element having at least two areas of thermally transferable colorant, at least one of said areas being a thermal dye transfer composition and at least one of said areas being a thermal mass transfer composition, which process comprises coating a first thermal dye or mass transferable layer containing a colorant onto a first substrate to form a primary thermal transfer element, said layer having a measurable surface area, and either 1) thermally transferring less than all of said layer onto a second substrate having a non-imagewise distributed area of a second thermally respectively mass or dye transferable colorant thereon to form a thermal transfer donor element with at least two areas of different thermally transferable materials, or 2) splicing a portion of a first thermal element having only one type of transferable material selected from dye or mass transfer materials thereon to a second thermal transfer element, said second thermal transfer element having at least a non-imagewise distributed second thermally transferable mass or dye colorant, respectively, thereon to form a multi-color thermal transfer donor element having at least one area of thermal dye transfer donor material and at least one area of thermal mass transfer donor material spliced adjacent to each other on said element.

23. A process for the manufacture of a thermal transfer donor element having at least two areas of thermally transferable colorant, at least one of said areas being a thermal dye transfer composition and at least one of said areas being a thermal mass transfer composition, which process comprises coating a first thermal dye or mass transferable layer containing a colorant onto a first substrate to form a primary thermal transfer element, said layer having a measurable surface area, and thermally transferring less than all of said layer onto a second substrate having a non-imagewise distributed area of a second thermally, respectively, mass or dye transferable colorant thereon to form a thermal transfer donor element with at least one area of thermal dye transferable material adjacent at least one area of thermal mass transferable material.

* * * * *